US005154295A

United States Patent [19]

Stoner

[11] Patent Number: 5,154,295

[45] Date of Patent: Oct. 13, 1992

[54] INTERLOCKING CONTAINER STRUCTURES

[76] Inventor: Theodore A. Stoner, 2375 E. Evans Ave., #17, Denver, Colo. 80210

[21] Appl. No.: 612,186

[22] Filed: Nov. 13, 1990

[51] Int. Cl.[5] ..... B65D 21/02

[52] U.S. Cl. ..... 206/509; 206/457; 206/504; 220/23.4; 446/124

[58] Field of Search ..... 206/457, 459, 503, 504, 206/508, 509, 150, 821; 220/23.4, 504; 446/71, 117, 124, 125; 215/10

[56] References Cited

U.S. PATENT DOCUMENTS

| | | | |
|---|---|---|---|
| 1,771,264 | 7/1930 | Marrits . | |
| 2,090,477 | 8/1937 | Graham | 220/97 |
| 2,292,310 | 8/1942 | Wilkins | 24/69 |
| 2,631,747 | 3/1953 | Stolte | 215/10 |
| 2,753,077 | 7/1956 | Greco | 220/97 |
| 3,422,564 | 1/1969 | Izumi | 46/22 |
| 3,815,281 | 6/1974 | Kander . | |
| 4,003,491 | 1/1977 | Wells et al. | 220/23.4 |
| 4,170,082 | 10/1979 | Freedman | 446/77 |
| 4,386,701 | 6/1983 | Galen | 206/509 |
| 4,582,447 | 4/1986 | Itoh | 403/305 |
| 4,593,818 | 6/1986 | Schenkman | 206/503 |
| 4,614,383 | 11/1986 | Moore | 220/23.4 |
| 4,624,363 | 11/1986 | Edwards | 206/150 |
| 4,690,271 | 9/1987 | Zak | 200/1.7 |

*Primary Examiner*—Joseph M. Moy
*Attorney, Agent, or Firm*—Dorr, Carson, Sloan & Peterson

[57] ABSTRACT

This invention is directed towards a means and method for interconnecting containers into structures, such as toys, displays or furniture as well as to provide packaging alternatives. The invention particularly relates to modifying a conventional six-pack of beverage cans so as to form the aforesaid structure without the use of additional components. Beverage cans are specifically utilized as said containers. The containers themselves have been modified such that they may be fastened together in a vertical manner without requiring any collars or other types of independent connecting means. "Connectors" have been provided for connecting the cans together in a side by side relationship. The interconnected containers form functional or promotional structures or a combination thereof as well as providing for packaging alternatives. Consequently, this serves as both a conservation and marketing aid.

7 Claims, 3 Drawing Sheets

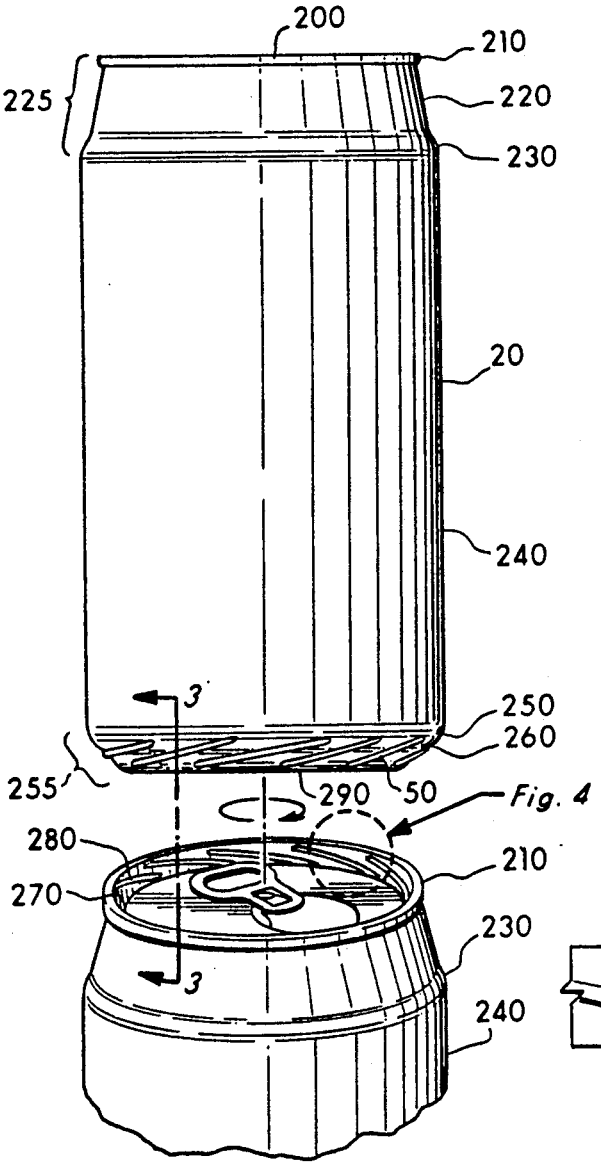
Fig. 2
Fig. 3
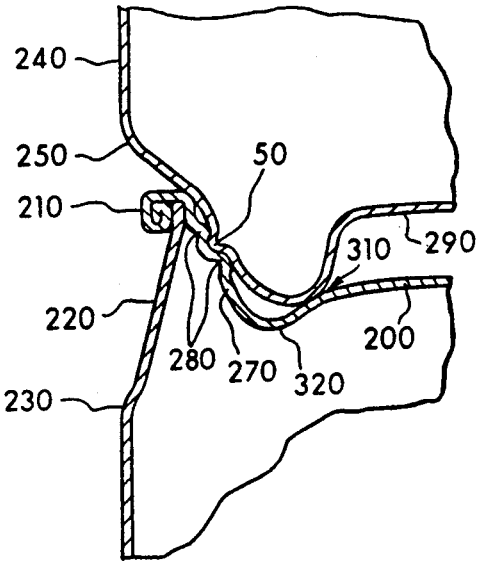
Fig. 4
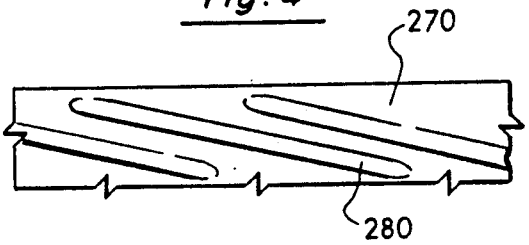
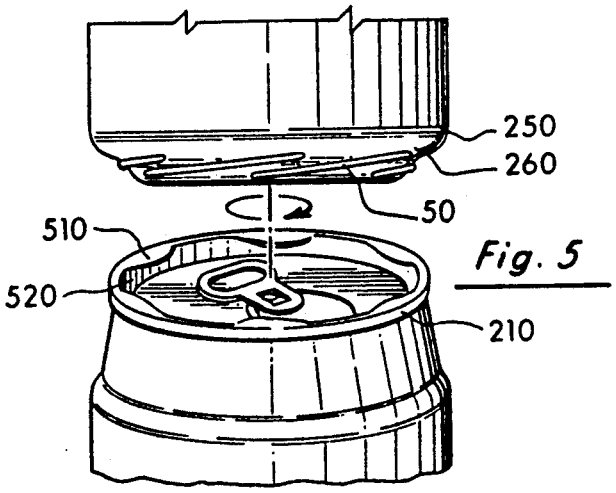
Fig. 5

INTERLOCKING CONTAINER STRUCTURES

BACKGROUND OF THE INVENTION

1 . Field of the Invention

This invention relates to a system for interconnecting containers, such as beverage cans; into structures, such as toys, displays and furniture; as well as to provide packaging alternatives. The invention more particularly relates to modifying a conventional six-pack of beverage cans so as to form the aforesaid structures without the use of additional components, all of which consequently serves as both a conservation and marketing aid.

2. Statement of the Problem

In this day and age, there has been much emphasis placed upon the need for recycling as a means for conserving our deplenishing natural resources as well as waste management. This recycling has encompassed everything from paper products, plastic, glass and metal of all types, including the recycling of aluminum beverage cans. When said beverage cans are recycled, they are melted, purified and then remolded into other shapes or containers. This process is expensive and requires extensive machinery in order to accomplish the recycling procedure. There thus exists the need for a means for recycling beverage containers without requiring a change in their physical state. The present invention is directed towards this recycling purpose. Namely, conventional beverage cans are modified at the point of manufacture such that the empty cans may be recycled into a new use, without using additional structural components, wherein the cans and the packaging material can be readily used as modular building components for children and others to create toys, displays, furniture, etc. By adding value to the empty beverage cans, this should also discourage the littering of the cans. Another need exists for retailers to be able to construct stable, three dimensional displays in order to advertise the product found in the can, when the cans are filled. Finally, the need exists for stable, interlocking stacking in packaging to create packaging alternatives.

3. Results of a Patentability Search

In the prior art search conducted, directed to the above need, three patents were discovered that allow a container to be recycled into a type of building block—the patents to Moore and Stolte. The patent to Moore (U.S. Pat. No. 4,624,383) discloses a container that can also be used as a toy building block. As shown, Moore utilizes a specifically designed food container that also serves to form children's toys, furniture etc. Likewise, Stolte (U.S. Pat. No.2,631,747) discloses another container specifically fashioned as a stackable, toy block. No means for attaching the containers together in a horizontal manner have been provided in Stolte.

Regarding the secondary need of using filled containers to form stable advertising displays and packaging alternatives, most grocery stores regularly simply stack food and beverage containers without using any form of interconnections. However, these stacked cans are unstable due to the lack of the presence of a mating connection either horizontally or vertically present between each can. To overcome this instability, collars have been provided to add to the stability as shown in the prior art. For example, in the patent to Itoh (U.S. Pat. No. 4,582,447) a collar is provided for interconnecting cans to form a display. Kander (U.S. Pat. No. 3,815,281) utilizes flexible, resilient plastic caps on beverage cans to create toy structures. The patent to Schenkman (U.S. Pat. No. 4,593,818) pertains to a collar device made of moldable elastic material and used for engaging the tops and bottoms of cans to form a stack of cans. Likewise, the patent to Wilkins (U.S. Pat. No. 2,292,310) discloses another collar or clamping band that is used to support one can upon another. Izumi (U.S. Pat. No. 3,422,564), Freedman (U.S. Pat. No. 4,170,082) and Graham (U.S. Pat. No. 2,090,477) each disclose separate interconnectable collars utilized to join either tubular or cylindrical elements together in both the vertical and horizontal dimensions. The tubular or cylindrical elements of all of the above cited references have however not been modified themselves in any manner whatsoever which is a crucial feature of the applicants claimed invention in that separate connecting means are not required in order for the cans to be securely fastened together in the vertical direction. Finally, the patent to Marrits (U.S. Pat. No. 1,771,264) discloses a series of stacked collars that are employed to form a stable structure of filled food cans. This patent is the most removed from the applicants invention as it necessitates the use of a central support post 6.

Containers have also been modified to form a more secure stacked structure. Wells et al (U.S. Pat. No. 4,003,491) sets forth modifications to the top and bottom rim structures of beverage containers to enable two adjacent containers to be secured together. Only FIG. 9 of Wells et al discloses vertical connections. Greco (U.S. Pat. No. 2,753,077) discloses cans having saw tooth edges that mesh together when one can is stacked upon the other. This sawtooth configuration makes these cans dangerous for use by children. The patent to Zak (U.S. Pat. No. 4,690,271) discloses threaded containers that may be secured together in a vertical stack (see FIG. 4) when removed from their traveling case.

None of the above cited prior art however is specifically addressed to the needs stated for the above problem for recycling beverage cans and their "holders" into building components, i.e. providing a new use for the beverage can. Most of the prior art requires separate collars for any vertical stacking of cans and of those that don't, secondary horizontal attaching means are lacking.

4. Solution to the Problem

The present invention solves both needs (i.e. enabling vertical and horizontal connections for (1) empty containers for building toys, furniture etc. and (2) filled containers for building retail displays and packaging alternatives) by modifying conventional cans and packaging material at the point of manufacture such that they are easily recycled while also providing a stable, integral vertical attaching means that allow stable, functional or promotional display structures to be constructed.

SUMMARY OF THE INVENTION

The invention is drawn to a means and method for utilizing beverage cans and plastic six-pack holders to build composite horizontal and vertical structures, as well as to provide packaging alternatives. The method comprises the steps of taking a plastic six-pack holder having three integral pairs of connectors, each of these pairs of connectors having opposed circular openings, perforating the common edges between said three pairs of connectors and separating the plastic six-pack holder into three pairs of opposed connectors by manually tearing through the perforations provided. Each circular opening provided in a connector is then forced over and about the upper lip of a beverage can such that said connector horizontally attaches two adjacent cans together. One of the openings in a second connector is then forced about the upper lip of one of the beverage cans already attached to the other while the second opening in the second connector is then forced about the upper lip of a third can such that three beverage cans are now joined horizontally together to form an array.

The top and bottom ends of each can have also been provided with formed integral interconnecting means such that the bottom of one beverage can may be selectively interconnected to the top of an adjacent can to form a vertically interconnected arrangement of stacked cans.

Thus, a beverage can is then vertically attached to the above cited horizontal array of beverage cans by placing the bottom end of one can on top of the top end of an adjacent can, aligning and then joining together the interconnecting means. The above steps are repeated until a composite horizontal and vertical structure of the desired height and shape is constructed.

The features of novelty which characterize this invention are pointed out with particularity in the claims annexed to and forming a part of this specification. The invention itself, however, both as to its organization and manner of operation, may be best understood upon reference to the following description taken in connection with the accompanying drawings, the figures of which are described briefly as follows.

DESCRIPTION OF THE DRAWING

FIG. 2 is a view showing an interlocking means provided on the tops and bottoms of each can;

FIG. 3 is a blown-up, sectional view taken on line 3—3 of FIG. 2 that illustrates how an interlocking means provided on the tops and bottoms of each can interact with one another.

FIG. 4 is an enlarged view of an interlocking means, or threads, provided on each can;

FIG. 5 is a view illustrating an alternate type of interacting means provided on the upper lip of the beverage can;

DETAILED DESCRIPTION OF THE INVENTION

1. General Applications

Figure 1:
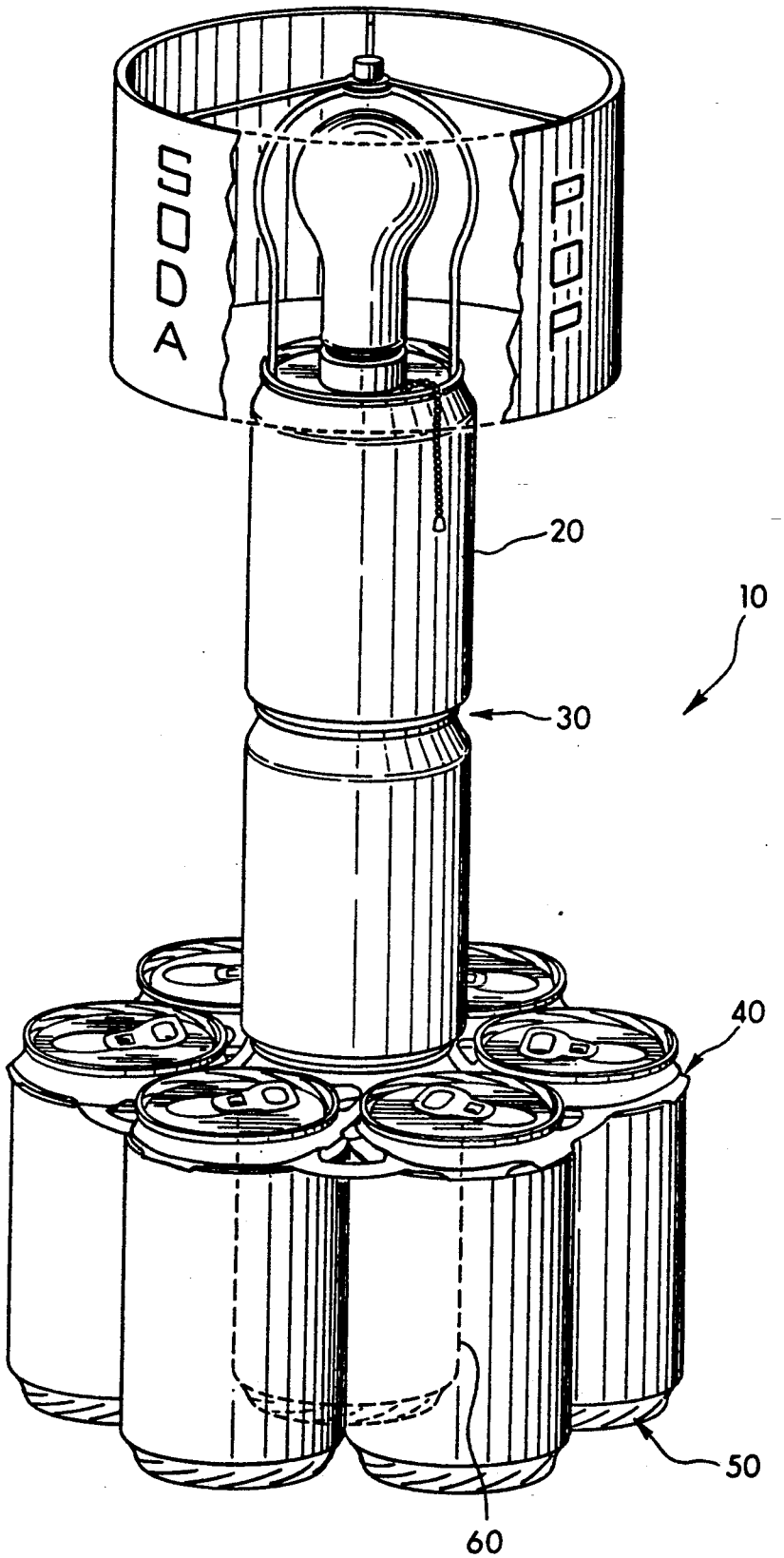
FIG. 1 is a perspective view of a composite structure made out of interlocked beverage cans.

FIG. 1 illustrates a particular application of this invention, namely, a perspective view of a composite structure 10 made out of interlocked filled and empty beverage cans 20. In this instance, the beverage cans 20 are horizontally attached together with connectors 40 to form a circular array that serves as a base for the illustrated lamp structure. Then, cans 20 are vertically interlocked together (as shown at vertical junction 30) with the center can 60 of the array (as shown in dotted lines in FIG. 1) to form the stem of the lamp. As shown, interlocking means 50 are provided on the base of each can to permit the interlocking of containers 20 together in the vertical direction. The center cans are empty to allow for the passage of electrical wiring therethrough while the horizontal cans are filled to provide a weighted base. By utilizing the interlocking beverage cans 20 and connectors 40, a functional or promotional display structure 10 has thus been assembled.

The interlocking beverage cans of this invention may be employed to make any number of structures either having a promotional or functional utility or both. For instance, interlocking beverage cans may be employed to make a lamp, as illustrated in FIG. 1, a piece of furniture such as a desk or a toy chest or they may even be utilized as a toy building block structure which may be played with by children. In addition, the cans may be assembled into an attention getting, promotional display that has no specific functional utility but is constructed merely as an art form or strictly as an advertising device. The cans 20 may be selectively left filled or empty—although most applications (other than for displays) will use empty cans. Packaging alternatives are also created. For example, a twelve (12) pack now can be packaged six (6) cans on top of six (6) cans with no case enclosure and still stay interconnected via the interlocking means of this invention. Packaging alternatives, by the number and design of cans, essentially become infinite.

As will be appreciated in the following, conventional beverage cans are modified at the point of manufacture so as to enable retail establishments to construct any type of three dimensional display in order to advertise the product found in the can. Furthermore, the empty cans may be recycled into a new use wherein the cans and the packaging material can be readily used as modular building components for children and others to create toys, displays, furniture, etc.

2. Definition of Beverage Container Components

Before discussing the features of the invention in detail, it is necessary to define the components of a typical prior art beverage container, as shown in FIGS. 2 and 3, that will be modified in accordance with this invention. This invention is directed towards a container, for example, a beverage can 20 (as illustrated in FIG. 2), comprised of a cylindrical, hollow body 240 having top 200 and bottom 290 ends that close and seal said hollow body. The cylindrical, hollow body 240 is comprised of an upper section 220 that leads to the lip 210 of said container, a uniform cylindrical body 240 and a lower nesting section 260 joined to the bottom end 290 of the container 20.

The upper section 225 of the can 20 comprises a first shoulder 230 attached to the cylindrical body 240 and joined at its upper end to a tapering neck 220 that in turn terminates in the upper lip 210 of the container 20.

The lower nesting section 255 of said can 20 comprises a second shoulder 250 attached to the body 240 on its upper end and to an inwardly tapering peripheral wall 260 on its lower end. The inwardly tapering peripheral wall 260 extends downwardly an appreciable distance below said second shoulder 250 to the point at which it terminates in a continuous, peripheral foot 310 (as illustrated in FIG. 3) which forms the bottom support for said container.

As shown in FIG. 3, the top end 200 of the container 20 is slightly convex in cross-section with a peripheral groove 320 positioned directly within and adjacent to an upstanding peripheral flange 270 that leads to the upper lip 210 of the container.

The bottom end 290 is concave in construction with said peripheral foot 310 forming the perimeter thereof. It is spaced inwardly from the outer perimeter of said container and sized such that said peripheral foot 310 substantially seats within the peripheral groove 320 provided on the top end 200 of another, adjacently positioned container. Conventionally, beverage cans are designed to "stack" wherein the peripheral foot 310 of the upper can nests in the peripheral groove 320 of the lower can. Each of the above features are old and well-known in the beverage can art with the patentable features being the following modifications made to said beverage containers. It is to be expressly understood that while conventional beverage cans are shown in the drawings, that the teachings of the present invention can be adopted to other stackable containers.

3. Integral Vertical Connections of Present Invention

Interlocking means (as illustrated in FIGS. 2–5) are provided on the tops 200 and bottoms 290 of each can 20 for vertically locking two stacked cans together. As shown in FIG. 2, the bottom of the can is provided with integral interlocking means 50, i.e. spiraling ribs or threads, on the inwardly tapering peripheral wall 260 that extends below the second shoulder 250 on said can 20. The tops 200 of each can have correspondingly been provided with interlocking means 280 on the inner surface of the upstanding peripheral flange 270 that leads to the upper lip 210 of said can 20. Said interlocking means provided on the base of the can and the upper end of each can have the same dimensions and pitch such that said containers 20 may be vertically connected together in a stack to form a composite structure 10. Each of the interlocking means are spaced such that the interlocking means 50 on the base of one container may laterally enter and be retained between two adjacent interlocking means 280 provided on the top end 200 of another adjacent container. As shown in FIG. 4, one particular type of interlocking means provided on the upper lip 210 of each can 20 are spiraling ribs or threads 280 that have been employed as an interlocking means.

As shown in FIG. 3, the threads 50 and 280 are "formed" in the walls of the container when the overall configuration of the container is being formed during manufacture of the container. Hence, the molds used to form the peripheral flange 270 and the peripheral wall 260 can be easily modified to form the desired interlocking thread structures 50 and 280. It is also to be expressly understood that beads of metal (such as, e.g., solder) could be deposited or otherwise placed in regions 260 and 270 to form interlocking threads.

An alternate type of interlocking means provided on the upper lip of the beverage can are illustrated in FIG. 5. In this embodiment, the lip 210 of the beverage can 20 has been provided with a plurality of equally spaced semi-circular protrubances 510 extending in an axially inward direction from the perimeter surface. Beneath these semi-circular protrubances, a continuous slot 520 has been provided for receiving the interlocking means 50, i.e. threads, ribs or lugs, that have been provided on the inwardly tapering wall 260 of the lower section of the can. Two adjacent cans of this type are vertically locked together by inserting the interlocking means 50, provided on the lower tapering wall 260 of a can 20, between the protrubances 510 and then rotating said cans 20 in alternate directions such that the interlocking means are 50 retainingly engaged by the protrubances 510 provided on the adjacent container.

From the above two embodiments (of many possibilities), it is clear that an interconnecting means can be formed in the upper section 225 and in the lower nesting section 255 of each container to vertically interlock stacked containers together. Whatever the interlocking means, it should provide level stacking with or without engaging the "interlocking means". Furthermore, it is to be expressly understood that the threads of the present invention are formed in a pattern so that before vertically interlocking in a vertical relationship with another container, the containers can be conventionally stacked in level relationship with each other. This is important to permit such containers, modified under the teachings of the present invention, to still be conventionally stacked without tipping.

4. Horizontal Connections of the Present Invention

Figure 6:
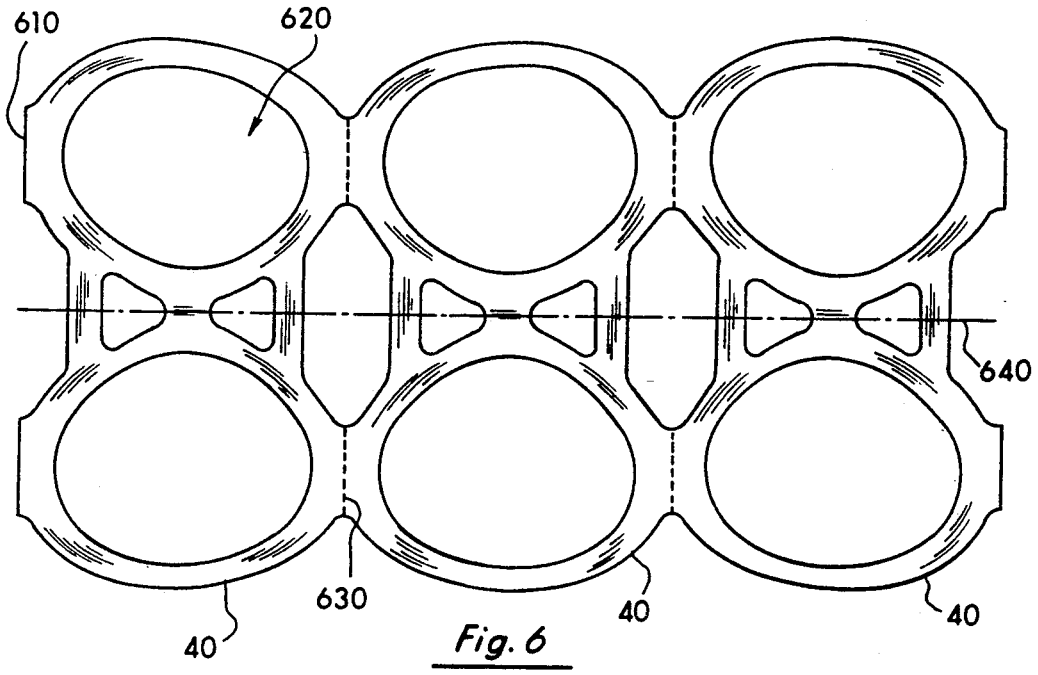
FIG. 6 is a view illustrating the typical six-pack holder provided with perforations thereon.
Figure 8:
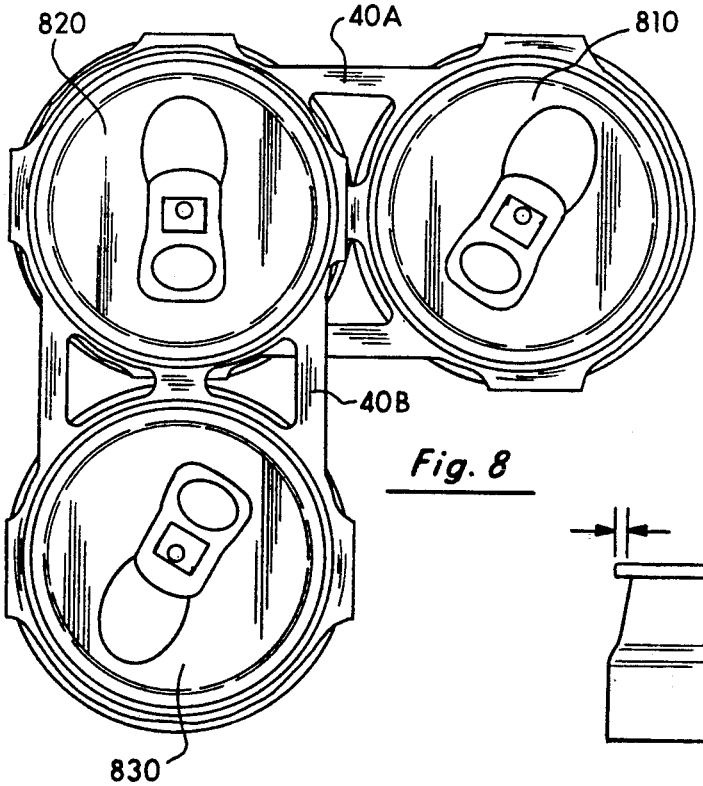
FIG. 8 is a top view showing how the beverage cans are horizontally connected together using the connectors made from a six-pack holder.
Figure 7:
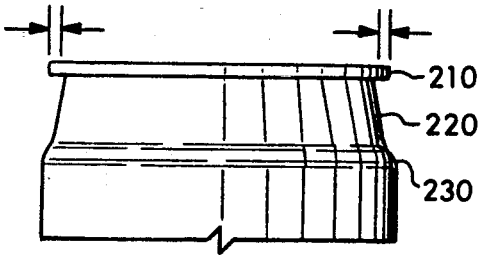
FIG. 7 is a view of the lip of a beverage can showing the enlarged peripheral section.

As stated previously, the beverage cans may also be locked together in the horizontal direction (as illustrated in FIGS. 6–8). This is achieved by employing connectors 40 made from a typical six-pack holder 610 from which the horizontal connecting means are made. The plastic six-pack holder 610 is conventionally comprised of a planar plastic element having three integral pairs of connectors 40, each of said pairs having opposed circular openings 620 sized such that each opening 620 fits tightly over and about the upper lip 210 of a beverage can 20. The common edges between said three pairs of connectors 40 are perforated 630 such that the plastic six-pack holder 610 may be separated into three pairs of opposed connectors 40 by manually tearing through the perforations 630 provided. It should also be noted that if the plastic six-pack holder 610 is not provided with perforations 630 then the connectors 40 may be separated from each other by cutting them apart. For example, rather than provided perforations, dotted lines may be printed on the package as a guide for cutting.

In order for the beverage cans 20 to accommodate the connectors 40, the lip 210 of each beverage can 20 must be enlarged as shown in FIG. 7. This enlarged peripheral section, or lip 210, is required in order to retain more than one connector 40 that is forced over the lip 210 of said container. The typical lip 210 provided on the upper perimeter of a beverage container is only deep and wide enough to retain one or two connectors 40 in position thereover. Therefore, in order to accommodate the multiple connectors that are forced over and about the upper lip of a container when forming a composite structure, this perimeter lip 210 must be enlarged during the manufacture of the container as shown in FIG. 7.

While FIGS. 6 and 8 represent a preferred embodiment, it is to be understood that the six-pack holder 610 may also be perforated or cut through the middle 640 to provide three horizontal connections or even left uncut, in full. The present invention is not limited to the pattern of cutting. It is to be expressly understood that under the teachings of the present invention modifications could be made to the plastic six pack holder 610 of FIG. 6 wherein the materials or the dimensional components of the edges of the circular opening 620 could be varied or modified to provide additional structural strength or engaging capabilities under the teachings of the present invention. For example, the thickness of the plastic element could be made thicker to provide more structural strength. Furthermore, color could also be added.

5. Method of Use

The method for assembling multiple beverage cans together by using connectors to form a composite structure is illustrated in FIG. 8. As stated above, the integral, plastic six-pack holder 610 is separated into three separate pairs of opposed connectors 40 by manually tearing through the perforations provided on their common edges 630. A single connector 40A is then used to horizontally connect two cans 810, 820 together by forcing each circular opening 620 provided in said single connector 40A over and about the upper lip 210 of a beverage can such that these two adjacent cans 810 and 820 are now connected together. Then, a circular opening of a second connector 40B is placed about the upper lip 210 of one (820) of the above beverage cans which is already attached to another (810) while the second circular opening 620 of said second connector 40B is placed about another beverage can 830 such that three beverage cans 810, 820 and 830 are now joined horizontally together to form an array. These steps are repeated until a horizontal array of the desired size and shape is formed. For example in order to form the lamp base of FIG. 1, several connectors are employed to connect every other perimeter can to the center can with the remaining perimeter cans being attached directly to an adjacent can to form a round base support for a lamp structure. Additional cans 20 are then vertically connected to the center can 60 such that together they form a lamp structure.

It can be well appreciated that the interlocked containers (vertically and horizontally) can be formed in numerous creative building structures such as toys, furniture, displays, packaging, and many other types of structures. For example, a novel three (more or less) pack arrangement for beverage cans could be formed from three containers of the present invention vertically interlocked.

While preferred embodiments of the present invention have been shown, it is to be expressly understood that modifications and changes may be made thereto and that the present invention is set forth in the following claims.

I claim:

1. A container comprising a hollow body having top and bottom ends wherein:

the top end is slightly convex in cross-section with a peripheral groove positioned directly within and adjacent to an upstanding peripheral flange that leads to a upper lip of said container; wherein the hollow body is uniformly cylindrical and comprised of an upper section, and a lower section joined to the uniform middle section; wherein the upper section of the cylindrical body comprises a first shoulder joined to a tapering neck that in turn leads to said upper lip of the container; and the lower section of said cylindrical body comprises an inwardly tapering peripheral wall extending downwardly an appreciable distance below a second shoulder to the point at which it joins a continuous, peripheral foot;

the bottom end is concave in construction with said peripheral foot forming the perimeter thereof spaced inwardly from the outer perimeter of said container and sized such that said peripheral foot substantially seats within the peripheral groove provided on the top end of another, adjacent container;

wherein said top and said peripheral foot have been provided with means for vertically interlocking together the tops and bottoms of adjacent containers in complementary retaining engagement to enable the construction of vertical composite structures consisting of plural interlocked containers, said interlocking means being formed in said top and said peripheral foot and integral therewith, said interlocking means preventing separation of said plural interlocking containers and wherein said peripheral flange, disposed about the perimeter of the top end and extending an appreciable distance upwardly therefrom, is provided with a plurality of spaced, interlocking means on the interior surface of the flange for receiving the corresponding interlocking means provided on the bottom end of another container.

2. A container comprising a hollow body having top and bottom ends wherein:

the top end is slightly convex in cross-section with a peripheral groove positioned directly within and adjacent to an upstanding peripheral flange that leads to a upper lip of said container; wherein the hollow body is uniformly cylindrical and comprised of an upper section, and a lower section joined to the uniform middle section; wherein the upper section of the cylindrical body comprises a first shoulder joined to a tapering neck that in turn leads to said upper lip of the container; and the lower section of said cylindrical body comprises an inwardly tapering peripheral wall extending downwardly an appreciable distance below a second shoulder to the point at which it joins a continuous, peripheral foot;

the bottom end is concave in construction with said peripheral foot forming the perimeter thereof spaced inwardly from the outer perimeter of said container and sized such that said peripheral foot substantially seats within the peripheral groove provided on the top end of another, adjacent container;

wherein said top and said peripheral foot have been provided with means for vertically interlocking together the tops and bottoms of adjacent containers in complementary retaining engagement to enable the construction of vertical composite structures consisting of plural interlocked containers, said interlocking means being formed in said top and said peripheral foot and integral therewith, said interlocking means preventing separation of said plural interlocking containers;

wherein the interlocking means provided on each top and bottom end comprise:

a plurality of integral, spaced, laterally extending ribs disposed upon the lower extremity of the generally cylindrical body; and a plurality of integral, spaced ribs provided on the upstanding flange which mate with the ribs provided on the lower extremity of the generally cylindrical body;

whereby the bottom end may be interlocked with the top end of an adjacent container after said bottom end has been inserted into said top end of an adjacent container; with each of said ribs being spaced such that they allow the ribs of another container to laterally enter and be retainingly received between two adjacent ribs on said container; and wherein the ribs of all of the containers have the same dimensions and pitch so that said containers may be connected together in a stack to form a structure.

3. A container comprising a hollow body having top and bottom ends wherein:

the top end is slightly convex in cross-section with a peripheral groove positioned directly within and adjacent to an upstanding peripheral flange that leads to a upper lip of said container; wherein the hollow body is uniformly cylindrical and comprised of an upper section, and a lower section joined to the uniform middle section; wherein the upper section of the cylindrical body comprises a first shoulder joined to a tapering neck that in turn leads to said upper lip of the container; and the lower section of said cylindrical body comprises an inwardly tapering peripheral wall extending downwardly an appreciable distance below a second shoulder to the point at which it joins a continuous, peripheral foot;

the bottom end is concave in construction with said peripheral foot forming the perimeter thereof spaced inwardly from the outer perimeter of said container and sized such that said peripheral foot substantially seats within the peripheral groove provided on the top end of another, adjacent container;

wherein said top and said peripheral foot have been provided with means for vertically interlocking together the tops and bottoms of adjacent containers in complementary retaining engagement to enable the construction of vertical composite structures consisting of plural interlocked containers, said interlocking means being formed in said top and said peripheral foot and integral therewith, said interlocking means preventing separation of said plural interlocking containers and wherein laterally extending ribs are disposed on the lower extremity of the generally cylindrical body and the ribs provided on the upstanding flange wall on the top end are screw threads.

4. The container of claim 3 wherein the screw threads are formed in a broken and discontinuous pattern so that before vertically interlocking said screw threads, said containers can be stacked in a level relationship.

5. The container of claim 3 wherein the screw threads are continuous.

6. A container comprising a hollow body having top and bottom ends wherein:

the top end is slightly convex in cross-section with a peripheral groove positioned directly within and adjacent to an upstanding peripheral flange that leads to a upper lip of said container; wherein the hollow body is uniformly cylindrical and comprised of an upper section, and a lower section joined to the uniform middle section; wherein the upper section of the cylindrical body comprises a first shoulder joined to a tapering neck that in turn leads to said upper lip of the container; and the lower section of said cylindrical body comprises an inwardly tapering peripheral wall extending downwardly an appreciable distance below a second shoulder to the point at which it joins a continuous, peripheral foot;

the bottom end is concave in construction with said peripheral foot forming the perimeter thereof spaced inwardly from the outer perimeter of said container and sized such that said peripheral foot substantially seats within the peripheral groove provided on the top end of another, adjacent container;

wherein said top and said peripheral foot have been provided with means for vertically interlocking together the tops and bottoms of adjacent containers in complementary retaining engagement to enable the construction of vertical composite structures consisting of plural interlocked containers, said interlocking means being formed in said top and said peripheral foot and integral therewith, said interlocking means preventing separation of said plural interlocking containers;

wherein the interlocking means provided on each top and bottom end comprise:

a peripheral portion of the bottom end being bent outwardly to form spaced lugs extending axially outwardly of said inwardly tapering peripheral wall; and a slot provided in the top end for receiving said lugs, extending along the inner surface of the upstanding peripheral flange that leads to a upper lip of said container; wherein the upper lip of the container is provided with a plurality of equally spaced semi-circular protrubances extending axially inwardly of the perimeter surface with said slot positioned directly beneath said protrubances such that when the lugs are inserted between the protrubances and then rotated into interlocking engagement such that the lugs are retainingly engaged by said protrubances on the adjacent container.

7. The container of claim 6 wherein the lugs are arranged in a downwardly spiraling pattern.

* * * * *